US007082805B2

(12) United States Patent
Ezaka et al.

(10) Patent No.: US 7,082,805 B2
(45) Date of Patent: Aug. 1, 2006

(54) MANUFACTURING METHOD FOR CYLINDRICAL PART

(75) Inventors: Shinichi Ezaka, Kariya (JP); Satoshi Sugiyama, Toyohashi (JP); Tomohiro Matsuura, Iwata (JP); Takafumi Watanabe, Iwata (JP); Tatsuya Ito, Iwata (JP); Nobuhisa Tako, Iwata (JP)

(73) Assignees: Denso Corporation, Kariya (JP); Nihon Pakkin Co., Ltd., Iwata-gun (JP)

( * ) Notice: Subject to any disclaimer, the term of this patent is extended or adjusted under 35 U.S.C. 154(b) by 23 days.

(21) Appl. No.: 10/978,041

(22) Filed: Nov. 1, 2004

(65) Prior Publication Data

US 2005/0115050 A1 Jun. 2, 2005

(30) Foreign Application Priority Data

Nov. 25, 2003 (JP) ..... 2003-394166

(51) Int. Cl.
*B21K 21/12* (2006.01)

(52) U.S. Cl. ..... 72/333; 72/348; 72/370.14

(58) Field of Classification Search ..... 72/348, 72/333, 327, 356, 370.14, 370.1, 370.01, 72/334, 275, 276
See application file for complete search history.

(56) References Cited

U.S. PATENT DOCUMENTS 5,179,854 A * 1/1993 Matsui et al. ..... 72/349
5,611,135 A 3/1997 Breese
5,622,070 A * 4/1997 Bulso, Jr. ..... 72/68
6,561,001 B1 * 5/2003 Sakuma et al. ..... 72/85
2004/0025446 A1 2/2004 Suzuki et al.
2004/0185337 A1 * 9/2004 Ishizaki ..... 429/164

FOREIGN PATENT DOCUMENTS

| | | |
|---|---|---|
| JP | A-5-38546 | 2/1993 |
| JP | A-7-144247 | 6/1995 |
| JP | A-7-256385 | 10/1995 |
| JP | A-7-275990 | 10/1995 |
| JP | A-9-103839 | 4/1997 |
| JP | A-2000-71046 | 3/2000 |
| JP | A-2000-74040 | 3/2000 |

* cited by examiner

*Primary Examiner*—Derris H. Banks
*Assistant Examiner*—Debra M Wolfe
(74) *Attorney, Agent, or Firm*—Nixon & Vanderhye P.C.

(57) ABSTRACT

It is an object of the present invention to provide a method of manufacturing a cylindrical part with a thin-walled portion at a lower cost, and according to the manufacturing method of the present invention, a base metal formed with thin-walled portion adjacent to its closed end can be easily detached from working jigs. According to the method, a thin-walled portion is at first formed by the ironing process on a cylindrical wall adjacent to the closed end, so that an outer-side step portion is formed on an outer peripheral surface of the cylindrical wall. Then the closed end is punched out and the thin-walled portion is enlarged in a radial and outward direction to form an inner-side step portion on an inner peripheral surface of the cylindrical part.

6 Claims, 8 Drawing Sheets

MANUFACTURING METHOD FOR CYLINDRICAL PART

CROSS REFERENCE TO RELATED APPLICATION

This application is based on Japanese Patent Application No. 2003-394166 filed on Nov. 25, 2003, the disclosure of which is incorporated herein by reference.

FIELD OF THE INVENTION

This invention relates to a manufacturing method for a cylindrical part, which has a thin-walled portion at least at one longitudinal end.

BACKGROUND OF THE INVENTION

As a method for manufacturing a cylindrical part having a thin-walled portion, such as, for example, a cylindrical part 300 with a thin-walled portion 302 at its one end, as shown in FIG. 13, a cutting process is possible. It is, however, disadvantageous in that a manufacturing cost will be increased because a working time becomes longer if the thin-walled portion 302 is formed by the cutting process.

As another method for manufacturing the cylindrical part with the thin-walled portion 302, an extrusion process can be applied, as disclosed in the following publications:

Japanese Patent Publication No. H5-38546,
Japanese Patent Publication No. 2002-153940,
Japanese Patent Publication No. 2000-74040,
Japanese Patent Publication No. H9-103839,
Japanese Patent Publication No. H8-270670,
Japanese Patent Publication No. H7-144247,
Japanese Patent Publication No. 2000-71046, and
Japanese Patent Publication No. H7-275990.

For example, as shown in FIGS. 14A and 14B, a base metal 340 of a cylindrical shape is held by a pilot 320 and a thin-walled portion 302 is formed by a backward extrusion process by a die 310 and a punch 330 having a step portion.

It is, however, necessary in such a method that a large pushing force must be applied to the punch 330 so that the punch 330 is plunged into the base metal 340, because the thin-walled portion 302 is formed in a manner that a part of the material for the base metal 340 flows backwardly (namely, in an opposite direction of the punch 330) being pressed. Furthermore, in such a backward extrusion process, the material of the base metal 340 flows, as indicated by an arrow in FIG. 14B, into a space formed between the die 340 and the punch 330, which is smaller than a space corresponding to a heavy-walled portion. Accordingly, a pressing force at the thin-walled portion, which is applied by the punch 330 to the base metal 340 in a radially outward direction toward the die 310, becomes extremely high. The pressing force becomes higher and higher, when thickness of the thin-walled portion becomes smaller and smaller.

As a result, a life time of working jigs, that is the die 310 and the punch 330, will become shorter, the base metal 340 may change its shape. Furthermore, the base metal 340 and the die 310, as well as the base metal 340 and the punch 330 may be adhered to each other, and therefore it may happen that the cylindrical part 300 can not be detached from the die 310. In FIGS. 14A and 14B, the material backwardly flows in an inner surface of the base metal, the same problem may occur in the case that a thin-walled portion is formed wherein a material backwardly flows in an outer surface of a base metal.

The inventors of the present invention studied another method for manufacturing a cylindrical part having a thin-walled portion at its one end, by an ironing process. In this manufacturing process, a base metal of a cylindrical shape with a closed end is formed, an inner wall of the closed end of the base metal is pushed by a punch, so that the base metal is extended by the ironing process during the punch is plunged into the base metal, a thin-walled portion is formed adjacent to the closed end, and the closed end is punched out, to finally form a cylindrical part having the thin-walled portion at one end. Since the base metal is extended in the ironing process, the ironing process can be performed by a smaller pressing force than that for the backward extrusion process. Accordingly, the adhesion between the base metal and the working jigs (the die and punch) may not occur. And since the base metal is processed by a smaller pressing force, the life time of the working jigs can be elongated.

In the above method for manufacturing the thin-walled portion adjacent to the closed end of the cylindrical base metal by the ironing process, however, it is not possible to form an inner side step portion at a boundary between the thin-walled portion and a heavy-walled portion. In the case that an outer side step portion is formed on a cylindrical part, an inner wall of a closed end of a base metal 400 is plunged by a punch 410, and an outer peripheral portion of the base metal 400 having the closed end is extended by the ironing process by a step portion 422 formed at an inner surface of a die 420. According to this method, the thin-walled portion 402 is formed adjacent to the closed end and the outer side step portion 404 due to a difference of thickness is formed on the outer periphery of the base metal 400.

In the above method, however, a material volume flowing from the thin-walled portion 402 to the heavy-walled portion 403 varies depending on a thickness of a base metal 400, when the base metals with a closed end has variation in its thickness before the base metal is processed, and thereby dimensional accuracy for a length of the heavy-walled portion is varied.

SUMMARY OF THE INVENTION

The present invention is made in view of the above problems, and it is an object of the present invention to provide a manufacturing method for a cylindrical part, for example, a housing for a fuel pump, which has a thin-walled portion at least at one longitudinal end of the cylindrical part and an inner-side step portion between the thin-walled portion and the other (heavy-walled) portion.

It is a further object of the present invention to provide a method of manufacturing the cylindrical part with the thin-walled portion at a lower cost, and according to the manufacturing method of the present invention, a base metal formed with thin-walled portion adjacent to its closed end can be easily detached from working jigs, such as a die, a punch and so on.

It is a further object of the present invention to provide a manufacturing method, according to which a thin-walled portion as well as a heavy-walled portion for a cylindrical part can be manufactured with a higher accuracy, even if there exist variations in thickness of a base metal.

According to a feature of the present invention, a cup-shaped base metal is at first formed, which has a cylindrical wall, a closed end and an open end at both sides of the cylindrical wall. A thin-walled portion is then formed by an ironing process on a portion of the cylindrical wall adjacent to the closed end, so that an outer-side step portion is formed between the thin-walled portion and the remaining (heavy-walled) portion of the cylindrical wall due to a difference of thickness of the walls of two portions. The closed end of the base metal is punched out, so that the thin-walled portion remains at the base metal. Then, the thin-walled portion is outwardly enlarged in its radial direction. As above, the cylindrical part having the thin-walled portion as well as an inner-side step portion can be manufactured by the ironing process, so that the manufacturing cost becomes lower than a method of a cutting process. Furthermore, a plunging force to the base metal by the working jigs (a die, a punch, an so on) can be made smaller than that in a backward extrusion process, so that an adhesion of the base metal to the working jigs can be prevented and thereby the base metal can be easily detached from the working jigs. Furthermore, a working force for the working jigs can be made smaller compared with the backward extrusion process, so that the lifetime of the working jigs can be elongated and the change of shape for the base metal can be prevented.

During the ironing process of the cylindrical wall adjacent to the closed end to form a thin-walled portion and a heavy-walled portion, a portion of the cylindrical wall is longitudinally extended so that a material of those portion flows from the thin-walled portion to the heavy-walled portion. When there are variations in thickness of the base metal for the cylindrical wall, a material volume flowing from the thin-walled portion to the heavy-walled portion varies depending on the variations of the thickness of the base metal, even when a length of longitudinal extension is controlled at a constant value. As a result, a dimensional accuracy at the heavy-walled portion may be decreased. Accordingly, in another feature of the present invention, a longitudinal length of the thin-walled portion, which will be formed by the ironing process at the cylindrical portion adjacent to the closed end, is adjusted depending on the thickness of the base metal.

According to a further feature of the present invention, when a thin-walled portion is formed by the ironing process at the cylindrical wall adjacent to the closed end, a longitudinal length of the thin-walled portion is made longer than a longitudinal length of the final product of the cylindrical part. And a positioning step portion is formed by the ironing process on the thin-walled portion at such a position, which corresponds to the longitudinal length required for the final product of the cylindrical part, and then the closed end is punched out. Accordingly, a dimensional accuracy for the longitudinal length of the thin-walled portion can be enhanced.

According to a further feature of the present invention, a thin-walled portion is formed by the ironing process on the cylindrical wall adjacent to its open end, and an inner-side step portion is thereby formed at a boundary between the thin-walled portion and the remaining cylindrical wall (heavy-walled portion) because of the difference of the thickness of the walls. Thereafter, the thin-walled portion is formed on the cylindrical wall according to the method mentioned above. As a result, the thin-walled portions are formed on both sides of the cylindrical wall, wherein inner-side step portions are respectively formed in the inner peripheral surface of the cylindrical wall.

When the cylindrical part having a thin-walled portion less than 3 mm is formed by the backward extrusion process, a larger punching force is applied to the base metal and thereby a larger force is applied to the base metal in a radial and outward direction. As a result, an adhesion of the base metal to a die or to a punch may occur and the base metal can not be easily detached from the die and the punch.

However, as mentioned above, the thin-walled portions are formed by the ironing process according to the present invention, the adhesion of the base metal to the die or the punch can be prevented and can be easily detached from the die and the punch, even when the thickness of the thin-walled portions is less than 3 mm.

BRIEF DESCRIPTION OF THE DRAWINGS

The above and other objects, features and advantages of the present invention will become more apparent from the following detailed description made with reference to the accompanying drawing.

In the drawing.

DETAILED DESCRIPTION OF THE PREFERRED EMBODIMENTS

An embodiment of the present invention will be explained with reference to the drawings, wherein an inner diameter and an outer diameter respectively designate a radius.

Figure 1:
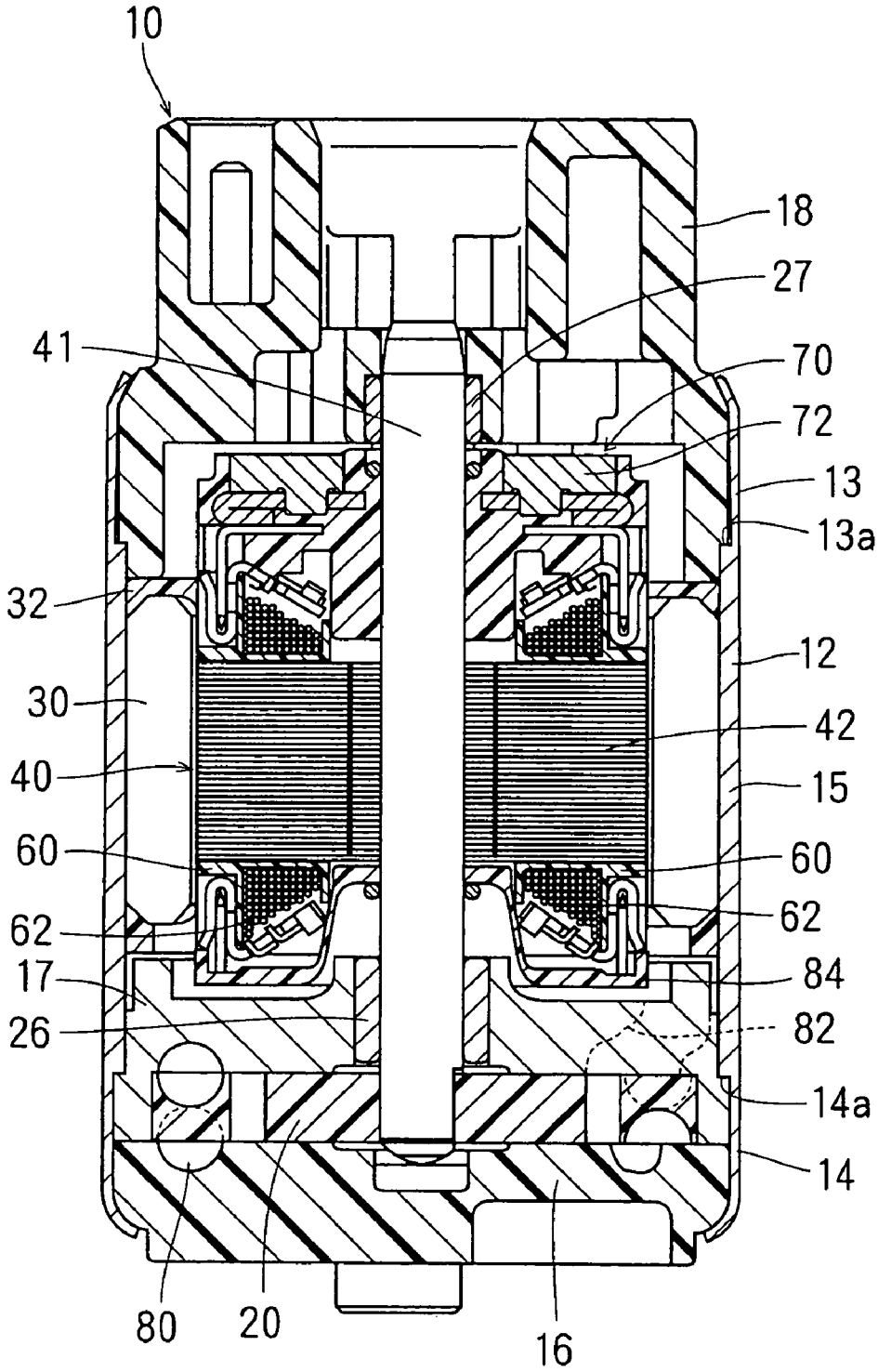
FIG. 1 is a cross sectional view of a fuel pump, in which a housing manufactured according to a method of the present invention is used.

A fuel pump according to an embodiment of the present invention is shown in FIG. 1. The fuel pump 10 is, for example, an in-tank type pump installed in a fuel tank of a motor vehicle. A housing 12 of a cylindrical shape is made of an iron or steel. The housing 12 is composed of thin-walled portions 13, 14 at both longitudinal ends, and a heavy-walled portion 15 between the thin-walled portions 13, 14. An inlet side cover 16 and a discharge side cover 18 are fixed to the housing 12 at the thin-walled portions 13, 14 by a caulking process (inwardly bending a peripheral end of the respective thin-walled portions). Inner-side step portions 13*a* and 14*a* are formed at an inner peripheral surface of the housing 12 at boundaries between the heavy-walled portion 15 and the thin-walled portions 13, 14. The thickness of the thin-walled portion can be freely chosen within a required range. In the case that the thin-walled portions 13, 14, the thickness of which is to be less than 3 mm, are formed by a conventional backward extrusion process, a base metal is likely adhered to process jigs (such as, a die, a punch and so on) and thereby it may become difficult to detach a processed work from the processing jigs. And therefore, in such a case, an ironing process is preferable in view of preventing the adhesion, as explained below. The thickness of the thin-walled portions 13, 14 is preferably less than 2 mm, when they are fixed to a counterpart (the inlet side and discharge side covers 16, 18 in this embodiment), by the caulking process.

A pump casing 17 is interposed between the inlet side cover 16 and the housing 12. A pump channel 80 of a C-shape is formed between the inlet side cover 16 and the pump casing 17. An impeller 20 is rotationally housed in a space defined by the inlet side cover 16 and the pump casing 17, wherein the impeller 20, the inlet side cover 16 and the pump casing 17 form a pump portion. The pump casing 17 holds a bearing at its central portion.

A plurality of blade grooves are formed at an outer periphery of the impeller 20, which has a disk shape. When the impeller 20 is rotated with a shaft 41 of an armature 40, a pressure difference is generated in the vicinity of the blade grooves of the impeller 20 by fluid friction, and fuel in the pump channel 80 is pressurized by repeating the generation of the above pressure difference by the plurality of the blade grooves. The fuel, which is sucked into the pump channel 80 from a fuel tank (not shown) through a fuel inlet port (not shown) formed in the inlet side cover 16, is discharged into a motor space formed through a communicating port 82 formed in the pump casing 17. The motor space is formed by the pump casing 17, discharge side cover 18 and the housing 12, and the armature 40 is rotationally housed in this motor space. A reference numeral 84 is an armature cover, and a reference numeral 70 designates a commutator. The fuel discharged into the motor space flows through a gap between the armature 40 and magnets 30 toward the commutator 70, and then discharged from the fuel pump 10 to an engine through a discharge port (not shown) formed in the discharge side cover 18.

The four permanent magnets 30 having an arc shape of one-fourth are fixed to the inner peripheral surface of the housing 12. The magnets 30 are polarized so that different poles are alternately arranged in a rotating direction of the armature 40. The permanent magnets 30 are held by a resin element 32.

The commutator 70 is assembled to an axial end of the armature 40, and the cover 84 is arranged at the opposite end of the armature 40. The permanent magnets 30, the armature 40, the commutator 70 and a brush device (not shown) form a direct current electric motor. The shaft 41 of the armature 40 is rotationally supported by bearings 26, 27, which are respectively held by the pump casing 17 and the discharge side cover 18.

The armature 40 comprises a coil core, which is divided into six poles. Multiple armature coils, each having a bobbin 60 and a winding 62 wound on the bobbin, are respectively fixed to the poles.

The commutator 70 has six segments 72 for supplying electric power to the armature coils. The segments 72 are formed of conductive material, such as copper, carbon and the like, and the adjacent segments are electrically insulated from each other.

A manufacturing process for the housing 12 will be hereinafter explained.

Figure 2:
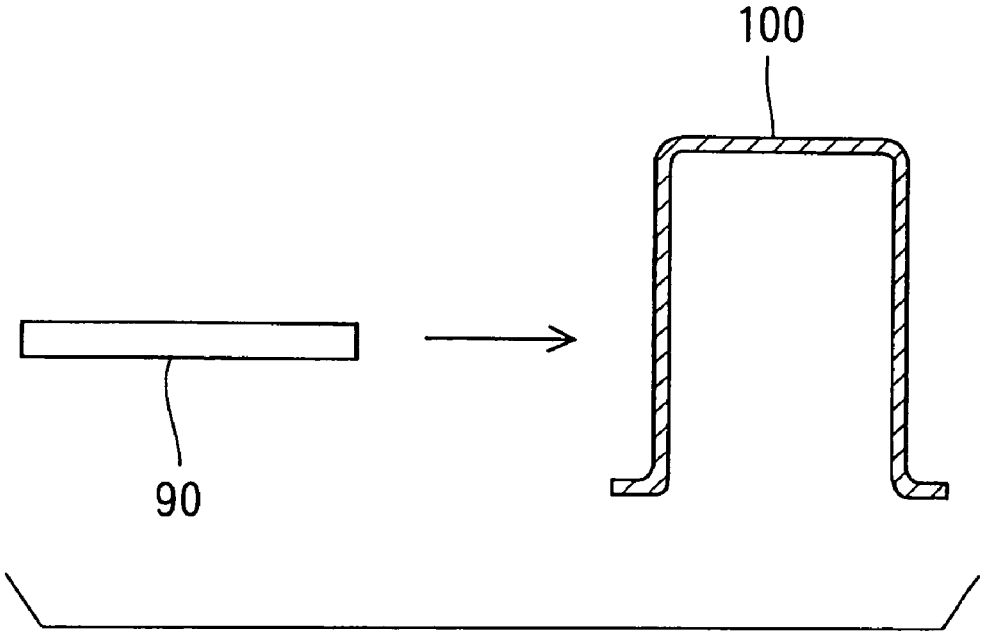
FIG. 2 is a schematic view of a base metal showing a pressing process of the present invention.

(1) Pressing Process:

A base metal 100 of a cup shape is made from a plate material 90 having the same thickness by a pressing process, as shown in FIG. 2, wherein the cup-shaped base metal has a cylindrical wall portion, an open end and a closed end at longitudinal ends of the cylindrical wall portion.

Figure 3A:
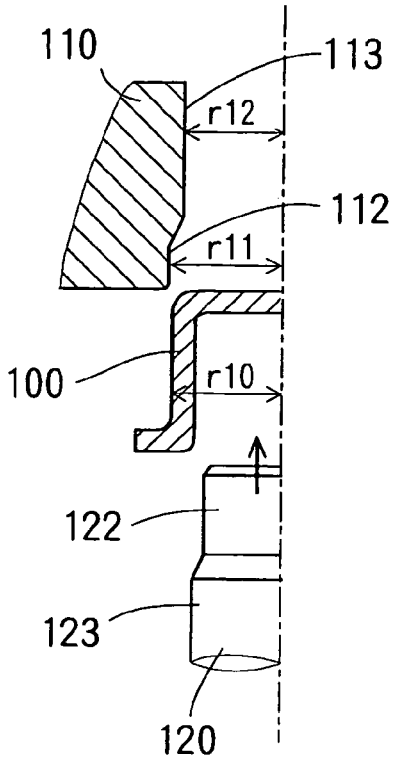
FIGS. 3A and 3B are explanation drawings for a squeezing process at a forward end of the base metal.
Figure 3B:
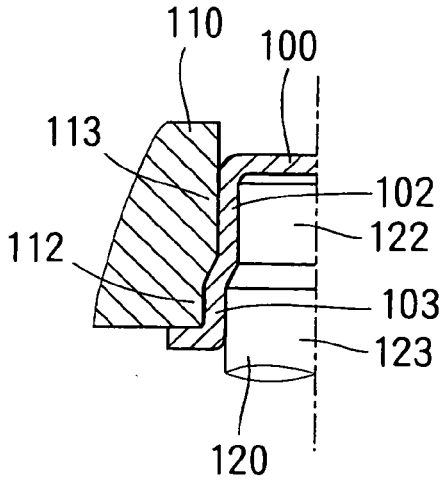

(2) Squeezing Work:

A thin-walled portion is formed at the open end of the base metal 100. As shown in FIG. 3A, a die 110 has a large-diameter portion 112 and a small-diameter portion 113, the inner diameter of which is smaller than that of the large-diameter portion 112. A punch 120 has a small-diameter portion 122 at its forward end and a large-diameter portion 123 at its backward portion. The inner diameter r11 of the large-diameter portion 112 of the die 110 is almost equal to an outer diameter r10 of the base metal 100, while the inner diameter r12 of the small-diameter portion 113 of the die 100 is smaller than the outer diameter r10. Accordingly, as shown in FIG. 3B, when the base metal 100 is plunged by the punch 120 from the large-diameter portion 112 to the small-diameter portion 113 of the die 110, the cylindrical wall adjacent to the closed end of the base metal 100 is squeezed.

Figure 4:
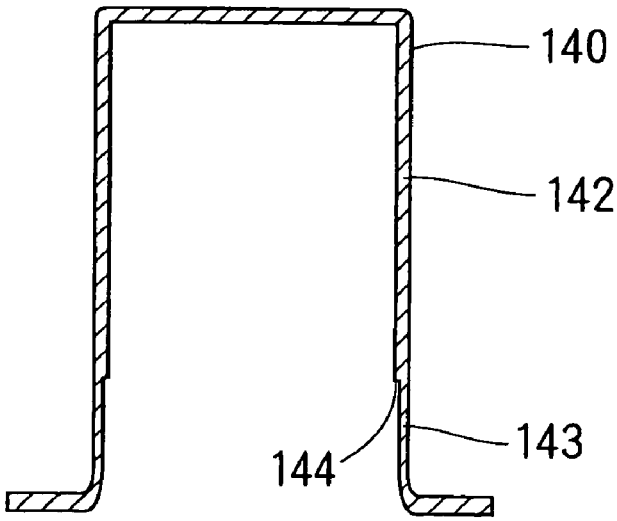
FIG. 4 is a cross sectional view of the base metal after the squeezing and ironing process are finished.
Figure 3C:
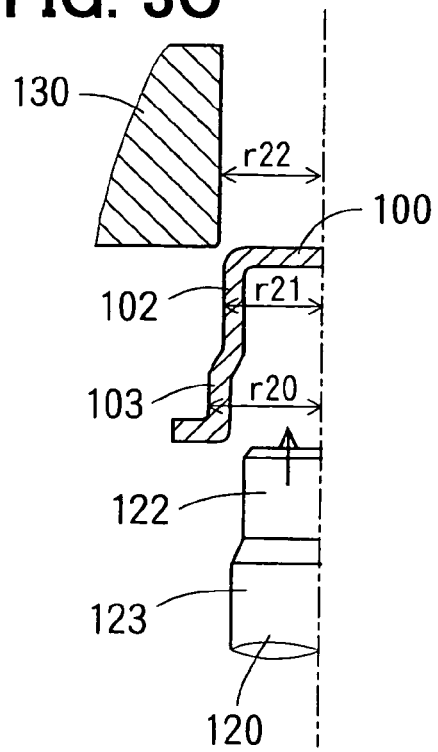
FIGS. 3C and 3D are explanation drawings for an ironing process at an open end of the base metal.
Figure 3D:
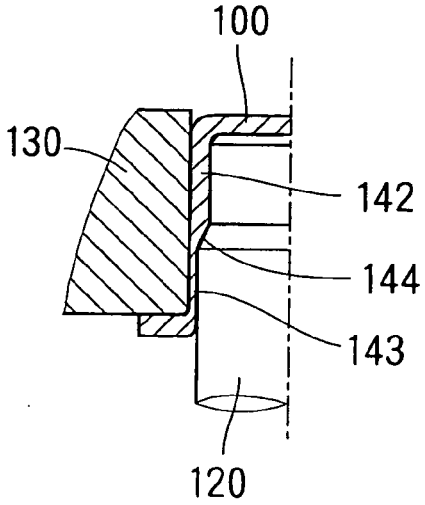

(3) Ironing Process at the Open End:

As shown in FIGS. 3C and 3D, an ironing work is processed at an outer peripheral portion of the base metal 100 at its open end by a die 130 and the punch 120. The inner diameter r22 of the die 130 is almost equal to an outer diameter r21 of a small-diameter portion 102 of the base metal 100 formed at the above squeezing process, while the inner diameter r22 is smaller than an outer diameter r20 of a large-diameter portion 103 of the base metal 100. The outer peripheral portion of the large-diameter portion 103 of the base metal 100 is processed by the ironing work, so that the large-diameter portion 103 is elongated toward the open end and the outer diameter is reduced. As a result, a thin-walled portion 143 is formed at the open end of the base metal 100. At the same time, an inner-side step portion 144 is formed because of a difference of the thickness between the thin-walled portion 143 and a heavy-walled portion 142 at its closed end. The inner-side step portion corresponds to the inner-side step portion 13*a* of the housing 12. As above and as shown in FIG. 4, a base metal 140 is formed, in which the thin-walled portion 143 is formed at its open end and thereby the inner-side step portion 144 is formed because of the difference of the thickness.

Figure 5A:
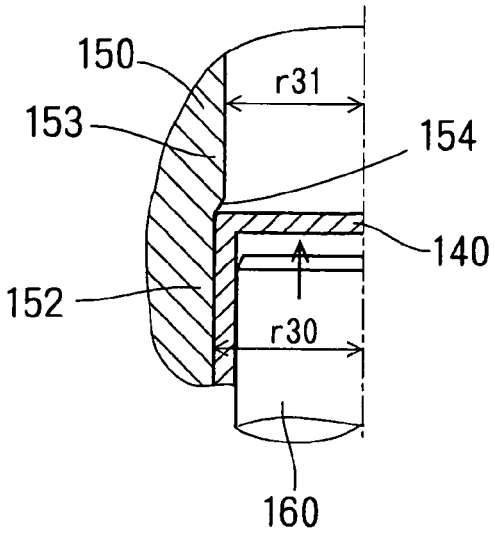
FIGS. 5A and 5B are explanation drawings for an ironing process at the forward end of the base metal.
Figure 5B:
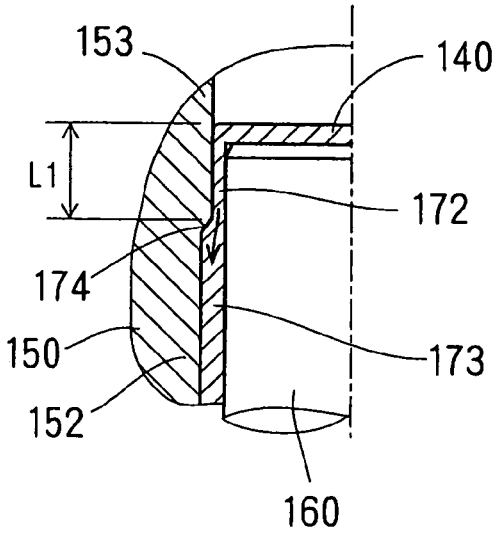
Figure 6:
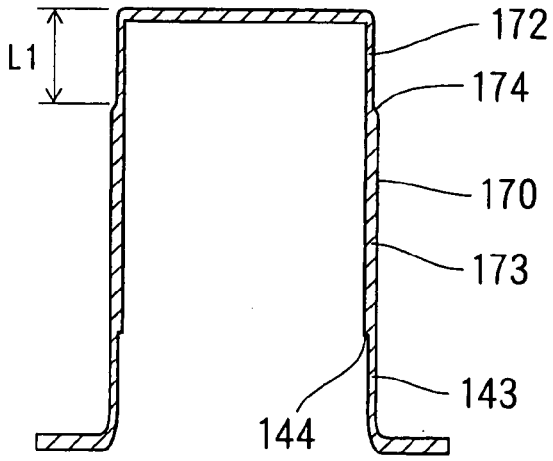
FIG. 6 is a cross sectional view of the base metal after the ironing process at the forward end is finished.

(4) Ironing Process at the Closed End:

A thin-walled portion will be formed at the cylindrical wall of the base metal 140 adjacent to its closed end by the ironing process. As shown in FIGS. 5A and 5B, a die 150 has a large-diameter portion 152 and a small-diameter portion 153, an inner diameter r31 of which is smaller than that r30 of the large-diameter portion 152, wherein the inner diameter r30 of the large-diameter portion 152 is almost equal to an outer diameter of the base metal 140. As shown in FIGS. 5A and 5B, when the closed end of the base metal 140 is plunged by a punch 160 upwardly in the drawing, an outer peripheral portion of the base metal 140 adjacent to the closed end is processed by the ironing work by the die 150, so that the cylindrical wall of this portion is elongated. As a result, a base metal 170 is formed, as shown in FIG. 6, which has a thin-walled portion 172 adjacent to its closed end and a heavy-walled portion 173 between the thin-walled portions 172 and 143. At the same time, an outer-side step portion 174 is formed between the thin-walled portion 172 and the heavy-walled portion 173 because of a difference of the wall thickness.

In the above ironing process shown in FIGS. 5A and 5B, the ironing work is processed at the outer peripheral portion of the base metal 140 while a portion of the base metal 140 is elongated. And therefore, a plunging force of the punch 160 is smaller than that for the backward extrusion process. Furthermore, a portion of material for the base metal 140 flows from the thin-walled portion 172 to the heavy-walled portion 173. Namely, the portion of the material flows into a space formed between the die 150 and the punch 160, which has a larger space. And thereby, a large force is not generated between the base metal 140 and the die 150, and between the base metal 140 and the punch 160. As a result, adhesion of the base metal 140 to the die 150 or to the punch 160 can be prevented. A longitudinal length L1 of the thin-walled portion 172 shown in FIG. 6, which is formed by elongating the base metal 140, is made longer than that L0 (shown in FIG. 12) of the thin-walled portion 14 of the housing 12, which is a length of the wall portion 14 before it is inwardly bent for fixing the inlet side or discharge side cover to the housing 12. Furthermore, as the heavy-walled portion 173 is formed as a result of the material flow from the thin-walled portion 172, the length L1 of the thin-walled portion 172 is determined by taking into consideration variation of the plate thickness for the base metal 140, so that a longitudinal length of the heavy-walled portion 173 becomes equal to a longitudinal length of the heavy-walled portion 15 of the housing 12.

Figure 7A:
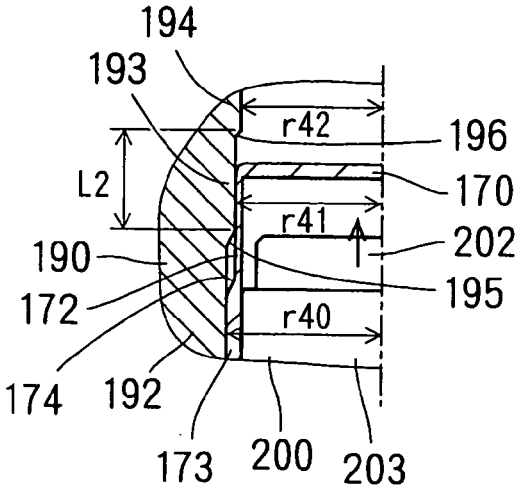
FIGS. 7A and 7B are explanation drawings for a process of forming a step portion.
Figure 7B:
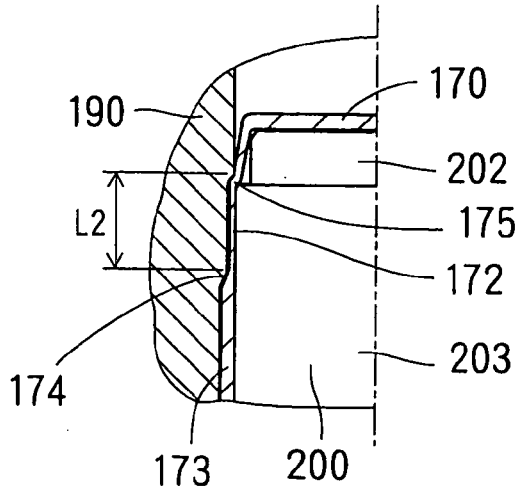
Figure 12:
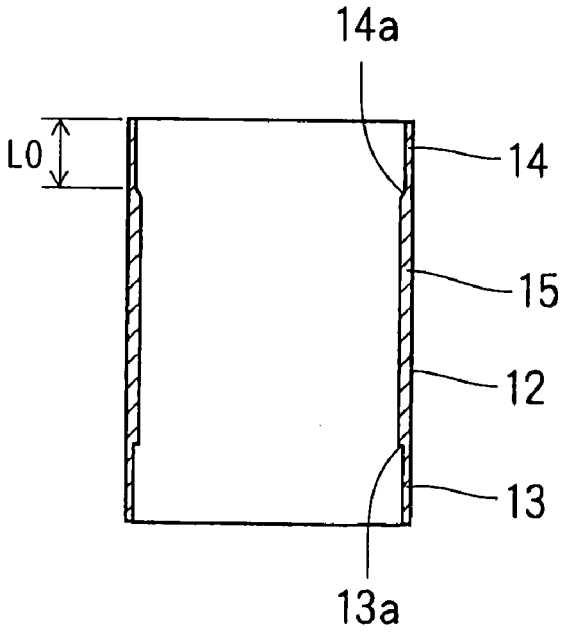
FIG. 12 is a cross sectional view of the housing for the fuel pump, which is manufactured according to the present invention.
Figure 13:
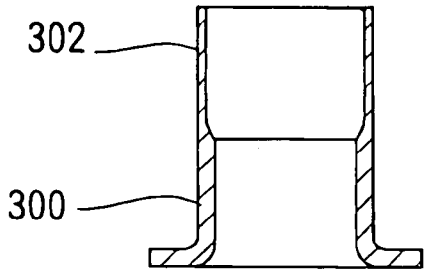
FIG. 13 PRIOR ART
FIG. 13 is a cross sectional view of a cylindrical part having an inner-side step portion, which is manufactured according to a prior art method.
Figure 14A:
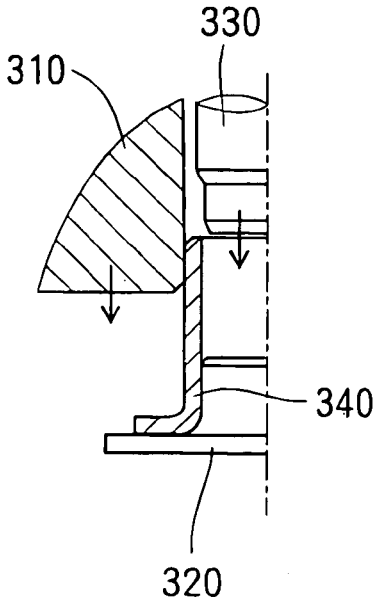
FIG. 14A PRIOR ART
FIGS. 14A and 14B are explanation drawings for a prior art manufacturing process of a backward extrusion method.
Figure 14B:
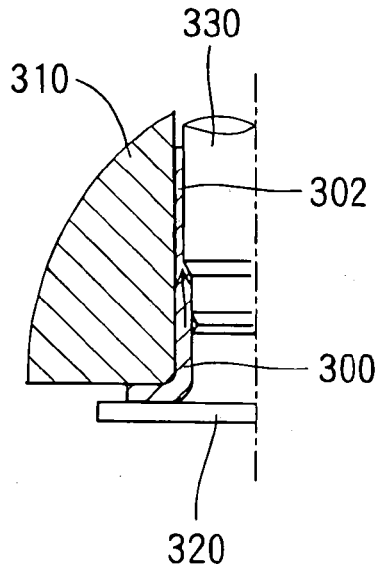
FIG. 14B PRIOR ART
Figure 15:
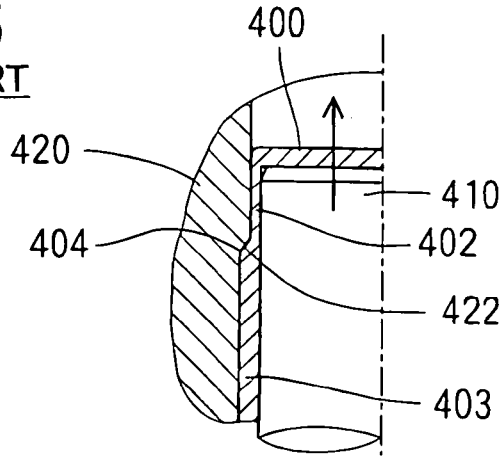
FIG. 15 RELATED ART
FIG. 15 is an explanation drawings for an ironing process at an outer peripheral surface of a base metal having a closed end (FIG. 15 does not belong to prior arts).

(5) Process for Forming the Step Portion:

As shown in FIGS. 7A and 7B, a positioning step portion 175 is formed close to the closed end of the base metal 170. As shown in FIG. 7A, a die 190 has a large-diameter portion 192, a middle-diameter portion 193 and a small-diameter portion 194. An inner diameter r40 of the large-diameter portion 192 is larger than an inner diameter r41 of the middle-diameter portion 193, which is then larger than an inner diameter r42 of the small-diameter portion 194. A punch 200 has a small-diameter portion 202 at its forward end and a large-diameter portion 203 at a backward portion thereof, which has a larger diameter than the small-diameter portion 202. The die 190 has two step portions 195 and 196, respectively formed at boundaries between the large-diameter portion 192 and the middle-diameter portion 193, and between the middle-diameter portion 193 and the small-diameter portion 194. A longitudinal length L2 between the above two step portions 195 and 196 is so determined that a material volume of a thin-walled portion 232 (which is the thin-walled portion after the closed end of the base metal is punched out in the following process, as shown in FIG. 8) corresponds to a material volume of the thin-walled portion 14 of the housing 12 before being inwardly bent (namely corresponds to a material volume of the thin-walled portion 14 having the length L0, as shown in FIG. 12).

As shown in FIG. 7B, when the base metal 170 is plunged by the punch 200 from the large-diameter portion 192 into the small-diameter portion 194, the thin-walled portion 172 is squeezed to form the positioning step portion 175. The positioning step portion 175 is formed at such a position, which corresponds to an end of the length L2 of the thin-walled portion 172.

Figure 8:
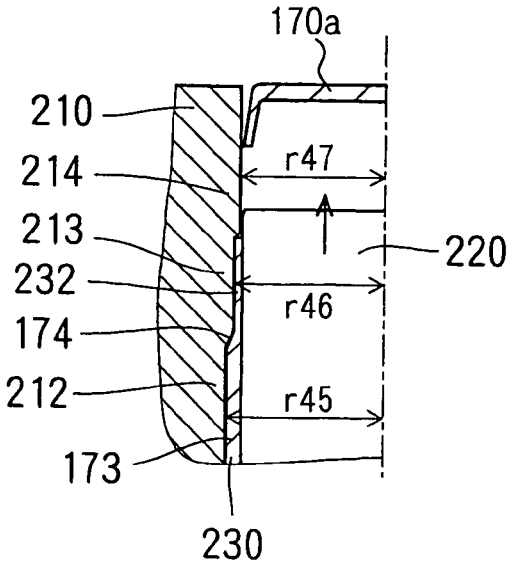
FIG. 8 is an explanation drawing for a process of punching out the forward end of the base metal.
Figure 9:
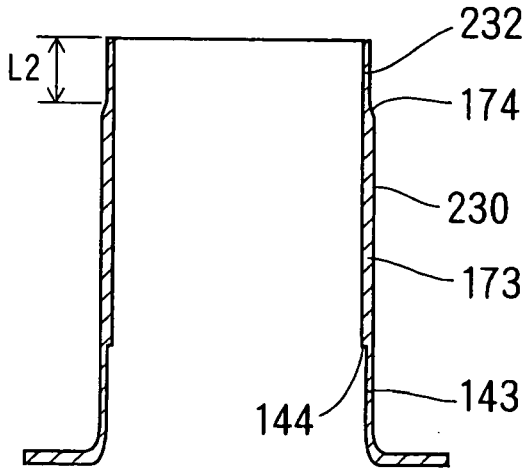
FIG. 9 is a cross sectional view of the base metal after the punching out process at the forward end is finished.

(6) Punching Out Process:

In this process, as shown in FIG. 8, the closed end of the base metal 170 is punched out. A die 210 has a large-diameter portion 212, a middle-diameter portion 213 and a small-diameter portion 214. An inner diameter r45 of the large-diameter portion 212 is larger than an inner diameter r46 of the middle-diameter portion 213, which is then larger than an inner diameter r47 of the small-diameter portion 214. When a punch 220 is plunged into the small-diameter portion 214, the closed end 170*a* of the base metal 170 is punched out from the positioning step portion 175. As a result, a base metal 230 shown in FIG. 9 is obtained, in which the thin-walled portions 143, 232 are formed and the heavy-walled portion 173 is formed between the thin-walled portions 143 and 232.

Figure 10A:
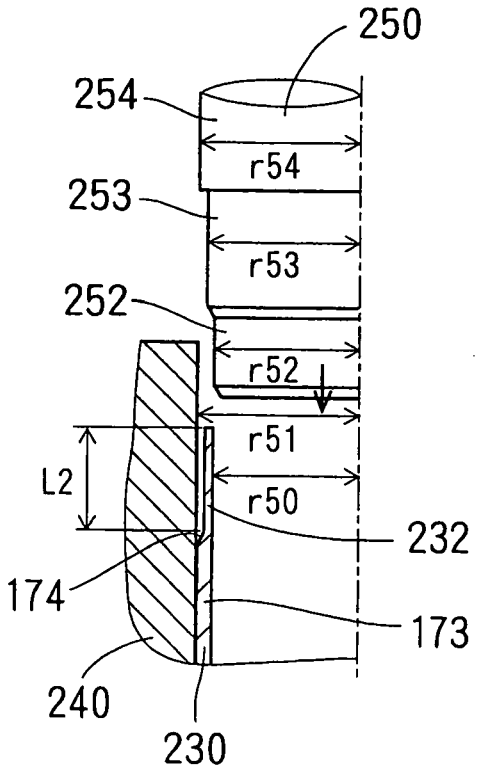
FIGS. 10A and 10B are explanation drawings for a process of enlarging a diameter of a thin-walled portion of the base metal adjacent to the punched-out forward end.
Figure 10B:
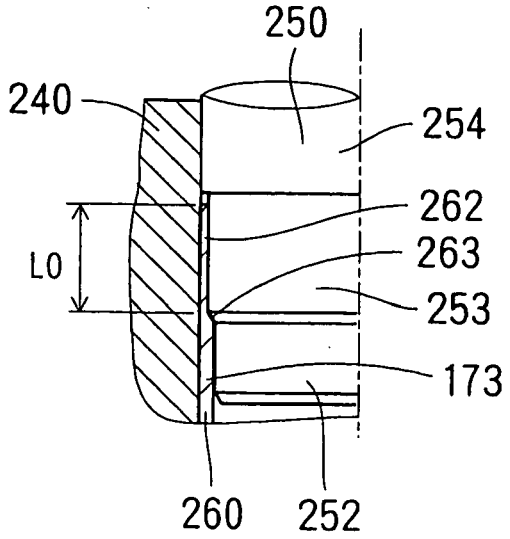

(7) Diameter Enlarging Process:

The thin-walled portion 232 of the base metal 230 is radially and outwardly enlarged, as shown in FIGS. 10A and 10B. A punch 250 has a small-diameter portion 252 at its forward end, a middle-diameter portion 253 having a larger outer diameter r53 than that r52 of the small-diameter portion, and a large-diameter portion 254 having a larger outer diameter r54 than that r53 of the middle-diameter portion. The outer diameter r52 of the small-diameter portion 252 is almost equal to an inner diameter r50 of the thin-walled portion 232 and the outer diameter r54 of the large-diameter portion 254 is almost equal to an inner diameter r51 of a die 240. When the punch 250 is plunged into the base metal 230, the thin-walled portion 232 is enlarged radially and outwardly to form a thin-walled portion 262. The length L2 of the thin-walled portion 232 becomes a length L0 of the thin-walled portion 262 after the expanding process, and an outer diameter of the thin-walled portion 262 becomes equal to that of the heavy-walled portion 173.

Figure 11:
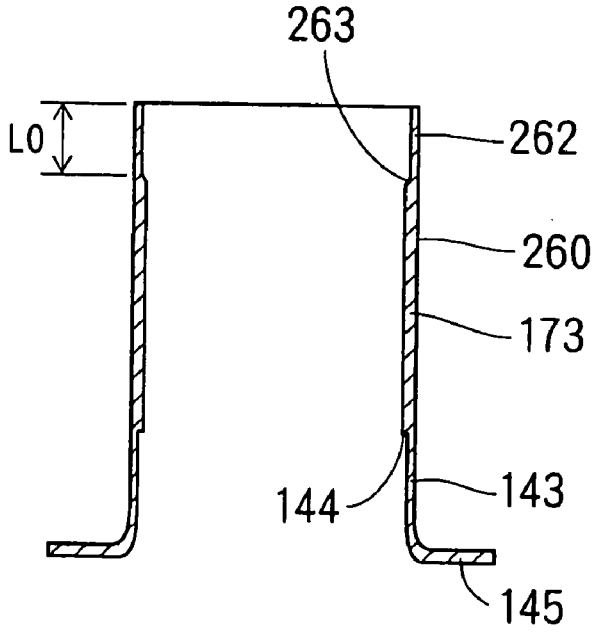
FIG. 11 is a cross sectional view of the base metal after the diameter enlarging process is finished.

Accordingly, a base metal 260 is formed, as shown in FIG. 11, in which the base metal 260 has thin-walled portions 262, 143 at both ends, and inner-side step portions 263, 144 formed at boundaries between the heavy-walled portion 173 and the respective thin-walled portions 262, 143. The thin-walled portion 262 and the heavy-walled portion 173 of the base metal 260 respectively correspond to the thin-walled portion 14 and the heavy-walled portion 15 of the housing 12, while the inner-side step portions 263, 144 respectively correspond to the inner side step portions 14*a*, 13*a*.

(8) Punching Out Process:

A flange portion 145 adjacent to the thin-walled portion 143 is punched out from the base metal 260 to form the final product of the housing 12, as shown in FIG. 12.

OTHER EMBODIMENTS

In the above embodiment, thin-walled portions are formed on both sides of the cylindrical part. The present invention can be also applied to a method of manufacturing a cylindrical part having a thin-walled portion at one side thereof.

According to such a modified method, a thin-walled portion is at first formed by the ironing process on a cylindrical wall adjacent to a closed end, so that an outer-side step portion is formed on an outer peripheral surface of the cylindrical wall. Then the closed end is punched out and the thin-walled portion is enlarged in a radial and outward direction to form an inner-side step portion on an inner peripheral surface of the cylindrical wall.

In the embodiments above, the word "closed end" does not mean an end completely closed, but includes such an end partly closed by an end portion of the cylindrical wall.

What is claimed is:

1. A manufacturing method for a cylindrical part, having a heavy-walled portion and a thin-walled portion at least at one of longitudinal ends so that an inner-side step portion is formed at an inner boundary between the heavy-walled and thin-walled portions, comprising:

a first step of forming a cup-shaped base metal by a pressing process so that the cup-shaped base metal has a cylindrical wall, a closed end and an open end at both longitudinal sides of the cylindrical wall;

a second step of forming a thin-walled portion at a portion of the cylindrical wall adjacent to the closed end by an ironing process at an outer peripheral portion of the cylindrical wall, so that an outer-side step portion is formed between the thin-walled portion and a heavy-walled portion which is the remaining portion of the cylindrical wall which is not processed by the ironing process;

a third step of punching out the closed end from the thin-walled portion, so that the base metal has the heavy-walled portion and the thin-walled portion; and a fourth step of enlarging the thin-walled portion radially and outwardly so that an inner-side step portion is formed at the boundary between the heavy-walled portion and the thin-walled portion.

2. A manufacturing method to claim 1, wherein a longitudinal length of the thin-walled portion, which is formed during the ironing process, is adjusted depending on a thickness of the base metal before the ironing process.

3. A manufacturing method according to claim 1, wherein a longitudinal length of the thin-walled portion of the base metal, which is formed during the second step of the ironing process, is made longer than a longitudinal length of the thin-walled portion of the cylindrical part, an outer diameter of a portion of the thin-walled portion closer to the closed end is made smaller between the second step of the ironing process and the third step of the punching-out process, so that a positioning step portion is further formed at an outer peripheral surface of the thin-walled portion of the base metal between the portion of the thin-walled portion for which the diameter is made smaller and the remaining portion of the thin-walled portion, and the closed end of the base metal is punched out from the positioning step portion.

4. A manufacturing method according to claim 1, further comprises:

a step of forming by a squeezing process a small-diameter portion and a large-diameter portion on the cylindrical wall, before the second step of the ironing process, wherein the small-diameter portion is formed on a side closer to the closed end, while the large-diameter portion is formed on a side closer to the open end of the base metal; and a step of forming another thin-walled portion at the large-diameter portion by an ironing process at an outer peripheral portion of the large-diameter portion.

5. A manufacturing method according to claim 1, wherein a thickness of the thin-walled portion is less than 3 mm.

6. A manufacturing method for a cylindrical part, having a heavy-walled portion and a thin-walled portion at least at one of longitudinal ends, comprising the steps of:

forming a cup-shaped base metal by a pressing process so that the cup-shaped base metal has a cylindrical wall, a closed end and an open end at both longitudinal sides of the cylindrical wall;

forming a thin-walled portion at a portion of the cylindrical wall adjacent to the closed end by an ironing process at an outer peripheral portion of the cylindrical wall, so that a longitudinal length of the thin-walled portion of the base metal, which is formed during the ironing process, is made longer than a longitudinal length of the thin-walled portion of the cylindrical part;

making smaller an outer diameter of a portion of the thin-walled portion closer to the closed end, to form a positioning step portion at the thin-walled portion of the base metal; and punching out the closed end of the base metal from the positioning step portion.

* * * * *